US010082041B2

(12) United States Patent
Bei et al.

(10) Patent No.: US 10,082,041 B2
(45) Date of Patent: Sep. 25, 2018

(54) METHODS AND SYSTEMS FOR PREVENTING LUBE OIL LEAKAGE IN GAS TURBINES

(71) Applicant: Nuovo Pignone SRL, Florence (IT)

(72) Inventors: Simone Bei, Florence (IT); Daniele Marcucci, Florence (IT); Maciej Hofman, Florence (IT); Marco Lazzeri, Florence (IT)

(73) Assignee: Nuovo Pignone Srl, Florence (IT)

( * ) Notice: Subject to any disclaimer, the term of this patent is extended or adjusted under 35 U.S.C. 154(b) by 243 days.

(21) Appl. No.: 14/783,602

(22) PCT Filed: Apr. 9, 2014

(86) PCT No.: PCT/EP2014/057118
§ 371 (c)(1),
(2) Date: Oct. 9, 2015

(87) PCT Pub. No.: WO2014/166978
PCT Pub. Date: Oct. 16, 2014

(65) Prior Publication Data

US 2016/0084111 A1 Mar. 24, 2016

(30) Foreign Application Priority Data

Apr. 10, 2013 (EP) ..... 13461525

(51) Int. Cl.
*F01D 25/16* (2006.01)
*F01D 25/20* (2006.01)
(Continued)

(52) U.S. Cl.
CPC ..... *F01D 25/20* (2013.01); *F01D 11/06* (2013.01); *F01D 25/16* (2013.01); *F01D 25/183* (2013.01); *F04D 19/002* (2013.01)

(58) Field of Classification Search
CPC ..... F01D 25/16; F01D 25/183; F01D 25/20; F01D 11/06
See application file for complete search history.

(56) References Cited

U.S. PATENT DOCUMENTS 4,497,172 A 2/1985 Smith
5,997,611 A * 12/1999 Doong ..... B01D 53/0476 95/101

(Continued)

FOREIGN PATENT DOCUMENTS

CN 1421594 A 6/2003
EP 155438 A2 7/2005

(Continued)

OTHER PUBLICATIONS

International Search Report and Written Opinion dated Sep. 8, 2014 which was issued in connection with PCT Patent Application No. PCT/EP14/057118 which was filed on Apr. 9, 2014.

(Continued)

*Primary Examiner* — Justin Seabe
*Assistant Examiner* — Behnoush Haghighian
(74) *Attorney, Agent, or Firm* — GE Global Patent Operation

(57) ABSTRACT

A sump pressurization system comprising an off-board source of pressurized air is provided to supplement pressurized air to a bearing sump arrangement when the operating conditions of the gas turbine engine are such that the on-board pressurized air source, e.g. the compressor of the gas generator, are such that the air pressure generated thereby is insufficient to pressurize a sump pressurization cavity. A gas turbine engine comprising such a sump pressurization system is also provided, as is a corresponding method for operating a gas turbine engine to facilitate reducing leakage of lubrication oil.

20 Claims, 6 Drawing Sheets

(51) Int. Cl.

| | |
|---|---|
| ***F01D 11/06*** | (2006.01) |
| ***F01D 25/18*** | (2006.01) |
| ***F04D 19/00*** | (2006.01) |

(56) References Cited

U.S. PATENT DOCUMENTS 6,035,484 A * 3/2000 Jones ..... B01D 46/0032 15/304
6,345,954 B1 * 2/2002 Al-Himyary ..... F04D 29/122 277/318
6,470,666 B1 * 10/2002 Przytulski ..... F01D 25/125 184/6.11
7,287,384 B2 10/2007 Fish et al.
7,836,675 B2 * 11/2010 Corattiyil ..... F02C 7/06 184/6.11
9,279,341 B2 * 3/2016 Durocher ..... F01D 25/125
2003/0097872 A1 5/2003 Granitz et al.
2004/0211726 A1 * 10/2004 Baig ..... B01D 53/22 210/640
2009/0317260 A1 12/2009 Mirsky et al.
2010/0263391 A1 * 10/2010 Tetu ..... F04D 27/0253 62/89
2012/0315137 A1 * 12/2012 Alvarez ..... F01D 25/18 415/229
2012/0328418 A1 * 12/2012 Yang ..... F01D 25/186 415/170.1
2013/0319798 A1 * 12/2013 Sheridan ..... F01D 25/20 184/6.11
2014/0026608 A1 * 1/2014 Manzo ..... F25B 39/04 62/305
2014/0150430 A1 * 6/2014 Helbig ..... F01K 13/02 60/656
2014/0377082 A1 * 12/2014 Lilie ..... F04B 7/0076 417/53
2015/0308445 A1 * 10/2015 Spagnoletti ..... F04D 29/16 415/110
2015/0369128 A1 * 12/2015 Parnin ..... F02C 7/06 60/772
2016/0305284 A1 * 10/2016 Mastro ..... F01D 25/20
2017/0114662 A1 * 4/2017 Mastro ..... F01D 25/20
2017/0175874 A1 * 6/2017 Schwarz ..... F16H 57/0435

FOREIGN PATENT DOCUMENTS

GB 2111607 A 7/1983
RU 2 117 794 C1 8/1998
RU 2 136 931 C1 9/1999
RU 2 470 206 C2 12/2012

OTHER PUBLICATIONS

European Search Report and Written Opinion dated Nov. 21, 2013 which was issued in connection with EP Patent Application No. 13461525.1 which was filed on Apr. 10, 2013.

Unofficial English Translation of Chinese Office Action and Search report issued in connection with corresponding CN Application No. 201480020516.0 dated Mar. 24, 2016.

Office Action and Search Report issued in connection with corresponding RU Application No. 2015141379 dated Jan. 9, 2018.

* cited by examiner

METHODS AND SYSTEMS FOR PREVENTING LUBE OIL LEAKAGE IN GAS TURBINES

BACKGROUND

Field of the Invention

The subject matter disclosed herein relates generally to gas turbine engines and more specifically to sump pressurization systems for gas turbine engines.

Description of the Related Art

Shaft bearings, such as for example ball bearings or roll bearings, are continuously fed with oil for lubrication and cooling purposes. Bearing assemblies are housed within sumps that are combined with a supply duct and an oil supply pump that supplies lubricating oil under pressure to the bearing assembly. A scavenge pump is further provided, that removes lubrication oil from the sump. The scavenge pump causes the return oil to pass through a heat exchanger prior to returning the oil to a tank or a reservoir. The bearing assembly sumps also include seal assemblies that facilitate minimizing oil leakage from the sumps along the rotor shaft.

U.S. Pat. No. 6,470,666 discloses methods and systems for preventing lubrication oil leakages from bearing assemblies in gas turbine engines. The systems disclosed therein include a sump oil cavity encasing a bearing assembly and in fluid communication with a lubrication oil supply for delivering pressurized oil to the bearing assembly and a scavenge pump for removing oil from this sump oil cavity. The sump oil cavity comprises sealing members for sealing a shaft passage preventing oil leakage along the rotating shaft from the interior towards the exterior of the sump oil cavity. The sump oil cavity is encased in a sump pressurization cavity surrounding the sump oil cavity and provided with further sealing arrangements preventing air from entering the sump pressurization cavity. The sump pressurization cavity is in fluid communication with a source of compressed air, arranged on board of the gas turbine engine. The pressure inside the sump pressurization cavity prevents oil leakages from the sump oil cavity towards the external sump pressurization cavity. The air pressure in the sump pressurization cavity also prevents hot external air from penetrating in the sump oil cavity. The air pressure in the sump pressurization cavity is maintained by a component driven by the gas turbine engine.

Typically, compressed air is delivered by the air compressor of the gas generator of the gas turbine itself. During engine low power and idle operations the pressure in the sump pressurization cavity may result insufficient to prevent oil leakages from the sump oil cavity. When the gas turbine operating conditions are such that the pressure in the sump pressurization cavity cannot be maintained at a sufficient level, the operating pressure in the sump oil cavity is reduced in comparison to the operating pressure of the sump pressurization cavity, using a venting system which is connected to a suction line for removing air from the sump oil cavity. This prevents oil leakages through the sealing arrangement of the sump oil cavity towards the sump pressurization chamber.

By reducing the operating pressure in the sump oil cavity, oil leakages are efficiently prevented. However, hot air present in the gas turbine engine area surrounding the bearing assembly can penetrate through the sump pressurization cavity and therefrom in the sump oil cavity leading to lubrication oil cooking due to the high temperature of such air.

There is therefore a need for improvements in bearing systems including an oil sump arrangement, specifically aimed at enhancing the operating conditions thereof when installed in hot areas of a rotating machine, such as a gas turbine.

SUMMARY OF THE INVENTION

According to the subject matter disclosed herein, a method of operating a gas turbine engine is provided, wherein an external (i.e. off board of the gas turbine engine) compressed air source is activated to provide sufficient compressed air to a sump pressurization cavity encasing a sump oil cavity housing a turbine bearing. The external compressed air source supplies sufficiently compressed air in case of insufficient pressure from the on-engine source of compressed air under certain operating conditions of the gas turbine engine. For example, the external, i.e. off-board compressed air source is activated when the gas turbine engine is running under low-power operating conditions or idle.

More specifically, according to some embodiments, a method for operating a gas turbine engine to facilitate reducing leakage of lubrication oil and oil cooking is provided, to be used in a gas turbine engine comprising at least one bearing assembly arranged in a sump oil cavity and a sump pressurization cavity at least partly encasing the sump oil cavity and in fluid communication therewith. The method comprises the steps of: supplying sump pressurization air to the sump pressurization cavity from the gas turbine engine, for example from one of the compressors of the gas turbine or from another on-board pressurized-air source, to maintain in the sump pressurization cavity an operating pressure higher than a pressure in the sump oil cavity and higher than the pressure around the sump pressurization cavity; and when air pressure from the gas turbine engine (i.e. from the on-board pressurized-air source) is insufficient to maintain the operating pressure in the sump pressurization cavity, supplying supplemental sump pressurization air to the sump pressurization cavity from at least one auxiliary pressurized-air source, i.e. an off-board source.

Generally speaking an on board or on-engine pressurized-air source can be any source of compressed air, which delivers an air pressure, which can be dependent upon the operating conditions of the gas turbine engine. Thus, under some operating conditions of the gas turbine engine the pressure of the air delivered by the on-engine source can be insufficient to properly pressurize the sump pressurization cavity. This condition can be detected, e.g. by a pressure transducer system. A signal provided by the pressure transducer system can be used to trigger delivery of pressurized air from the off-board source. In general terms, the off-board source can provide a delivery pressure which is independent or partly independent upon the operating condition of the gas turbine engine. The off-engine or off-board source of pressurized air can include a blower, e.g. a positive displacement blower. In other embodiments a line of compressed air can be provided. Both a blower and a line of pressurized air can be provided in combination in some embodiments. The air blower, if present, can be driven by an electric motor. According to embodiments of the present invention, the rotation speed of the motor and of the blower can be controllable, to provide the correct air pressure in the sump pressurization cavity.

Further features and embodiments of the method according to the subject matter disclosed herein are set forth in the attached claims.

According to a further aspect, the subject matter disclosed herein relates to a sump pressurization system for a gas turbine engine, comprising a sump oil cavity housing a bearing assembly and a sump pressurization cavity at least partly encasing the sump oil cavity and in flow communication therewith. The system further comprises a supplemental pressurized-air delivery line for flow connection between the sump pressurization cavity and at least one auxiliary pressurized-air source, i.e. an off-board source of pressurized air. Moreover, a pressurized-air line is provided, for flow connection between the sump pressurization cavity and an on-board source of pressurized air, i.e. as source arranged on the gas turbine engine. The auxiliary pressurized-air source can be an off-engine source, capable of delivering air at a pressure which is at least partly, in an embodiment independent of the operating conditions of the gas turbine engine, while the on-board source (e.g. the compressor of the gas generator of the gas turbine engine) is at least partly dependent upon the operating conditions of the gas turbine engine. A valve arrangement is provided, for connecting the sump pressurization cavity selectively: with the pressurized-air line in fluid communication with the on-board pressurized air source, or with the supplemental pressurized-air delivery line in fluid communication with the off-board source of pressurized air.

Further embodiments and features of the system are set forth in the enclosed claims.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s).

Further, the particular features, structures or characteristics may be combined in any suitable manner in one or more embodiments.

Figure 1:
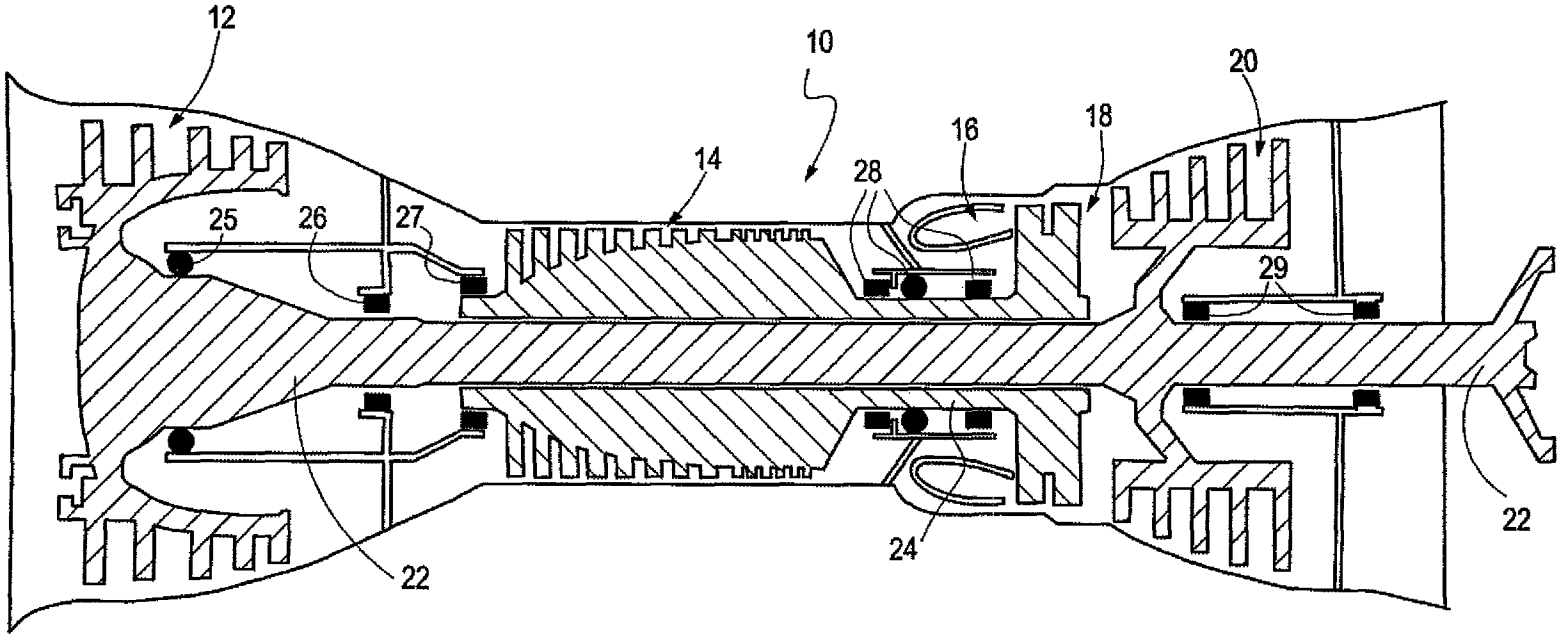
FIG. 1 illustrates a longitudinal section of an exemplary gas turbine engine embodying the system of the present disclosure.

FIG. 1 is a schematic sectional illustration of a gas turbine engine 10 including a low pressure compressor 12, a high pressure compressor 14, and a combustor 16. The gas turbine engine 10 further includes a high pressure turbine 18 and a low pressure turbine 20. The low pressure compressor 12 and the low pressure turbine 20 are coupled by a first shaft 22. The high pressure compressor 14 and the high pressure turbine 18 are coupled by a second shaft 24. The shafts 22 and 24 are coaxial, shaft 24 surrounding shaft 22. Through shaft 20 the low pressure turbine 20 can be connected, directly or through gear box, to a load (not shown), for example a compressor or an electric generator. The hot end of the gas turbine engine is the side where the low pressure turbine 20 is arranged. The cold end of the gas turbine engine is the side where the low pressure compressor 12 is located.

An example of such a gas turbine engine is commercially available from by General Electric Company of Evendale, Ohio under the designation LM6000. A further gas turbine engine wherein the subject matter disclosed herein can be incorporated is an LM2500 or LM2500+ gas turbine engine, both commercially available from General Electric Company, Cincinnati Ohio, USA.

The gas turbine engine comprises a plurality of bearing assemblies some of which are schematically illustrated in FIG. 1. More specifically, bearing assemblies are shown at 25, 26, 27, 28 and 29. In particular, the bearing assembly 28 is located in a hot area of the gas turbine engine, i.e. at or near the combustor of the gas turbine. In this area of the gas turbine engine the air surrounding the bearing assembly is particularly hot due to the high temperature of the combustion gases generated in the combustor.

Figure 2:
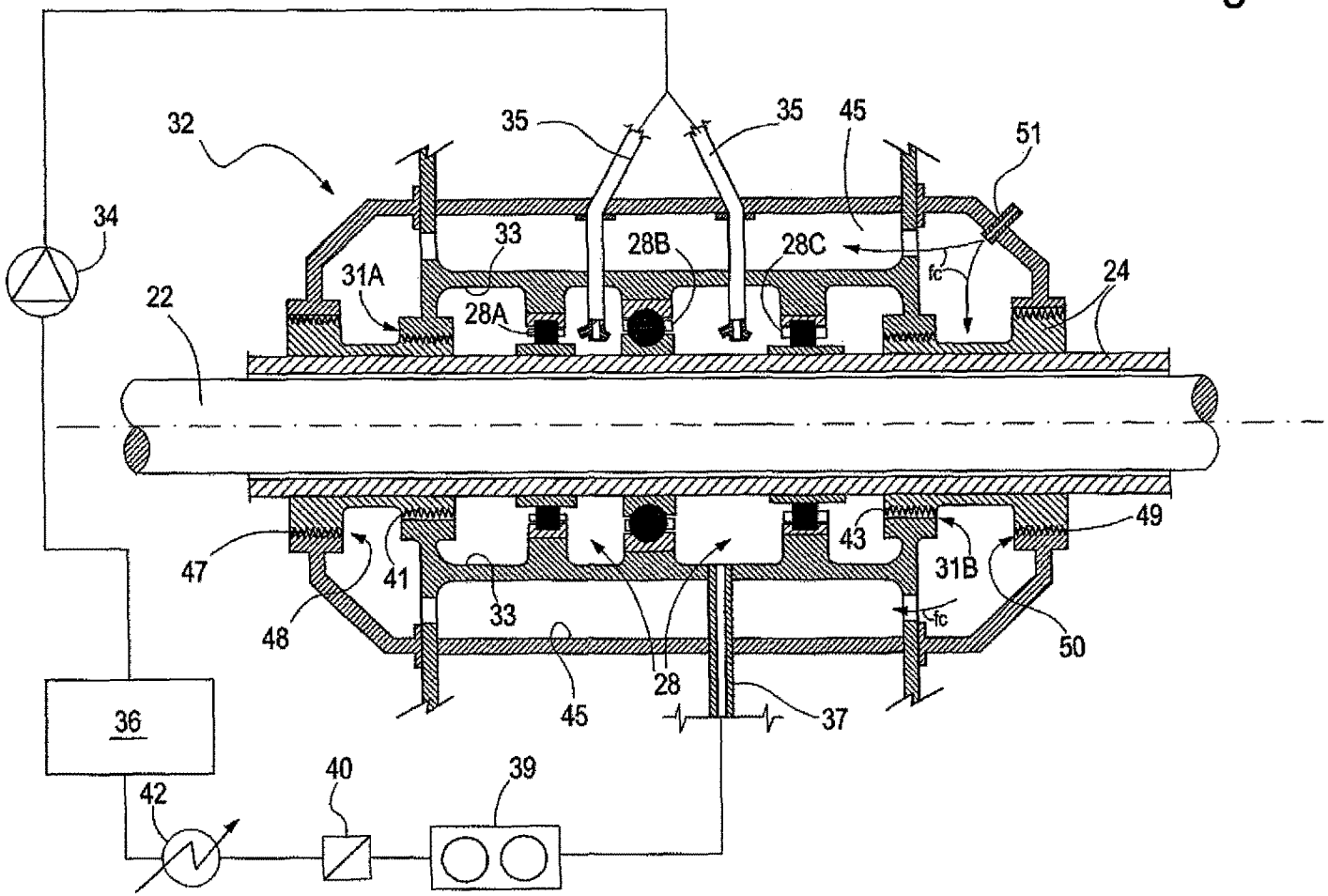
FIG. 2 schematically illustrates a longitudinal section of a bearing arrangement according to the present disclosure.

FIG. 2 schematically illustrates one embodiment of the bearing assembly 28 and relevant bearing sump. The bearing sump is globally labeled 32. In some embodiments the bearing assembly 28 is comprised of three bearings 28A, 28B, 28C arranged in the bearing sump 32. A sump oil pressurization cavity 45 surrounds the bearing assembly, as will be described in greater detail later on.

FIG. 2 schematically illustrates also a portion of shaft 24 supported by the bearing assembly 28 and a portion of the inner shaft 22 extending through shaft 24. In other embodiments, as known to those skilled in the art, the gas turbine engine 10 can be comprised of a single shaft or may be provided with more than one shaft but in a non-concentric arrangement. The bearing assembly of FIG. 2 can be utilized also in those different gas turbine configurations.

According to some embodiments, the bearing assembly 28 is housed within a sump oil cavity 33. The interior of the sump oil cavity 33 can be in fluid communication through oil supply ducts 35 with a lubrication oil tank, schematically shown at 36. Pressurized oil is delivered to the bearing assembly 28 through the oil supply ducts 35, for example by means of a pump 34 in fluid communication with the lubrication oil tank 36. In some embodiments an oil removal duct 37 ending in the interior of the sump oil cavity 33 is in fluid communication with a scavenge pump schematically shown at 39. The oil removed from the sump oil cavity 33 through the scavenge pump 39 can be delivered through a filter 40 and for example also through a heat exchanger 42 and returned to the lubrication oil tank 36.

Lubrication oil supplied through the oil supply ducts 35 lubricates the bearings 28A, 28B, 28C of the bearing assembly 28, removes heat therefrom, and is then returned through the oil removal duct 37 and the scavenge pump 39 to the lubrication oil tank 36 after having been filtered in filter 40 and cooled in heat exchanger 42.

In the exemplary embodiment of FIG. 2, the sump oil cavity 33 is provided with first sealing members 41, 43, defining shaft passageways 31A, 31B through the sump oil cavity 33. The sump oil cavity 33 is encased in a sump pressurization cavity 45. The sealing members 41 and 43 prevent or reduce oil leakage from the sump oil cavity 33 towards the sump pressurization cavity 45 along the shaft 24 which extends through the shaft passageways 31A, 31B.

The sump pressurization cavity 45 comprises further sealing members 47, 49 through which the shaft 24 extends and which prevent or reduce air leakage from the sump pressurization cavity 45 towards the exterior. Second shaft passageways 48, 50 are surrounded by the sealing members 47, 49, the shaft 24 extending through the second shaft passageways. The air pressure in the sump pressurization cavity 45 prevents or limit lubrication oil leakages through the sealing members 41 and 43. The air pressure further prevents hot air penetration through the sealing members 47 and 49 into the sump pressurization cavity 45 and consequently into the sump oil cavity 33.

During normal engine operation, air is ingested by the low pressure compressor 12, compressed at a first pressure by the compressor, delivered to the high pressure compressor 14 and further compressed at a final pressure. The compressed air flows in the combustor 16, where the compressed air flow is mixed with fuel and the mixture is ignited to generate combustion gas at high temperature and high pressure. The combustion gas is sequentially expanded in the high pressure turbine 18 and in the low pressure turbine 20 respectively. Power generated by the high pressure turbine 18 is used to drive the high pressure compressor 14. Power generated by the low pressure turbine 20 is partly used to drive the low pressure compressor 12 and partly available on the shaft 20 for driving the load (not shown).

Lubrication oil is circulated in the bearing assemblies 25-29. Pressurized air taken from an on-engine source of compressed air is delivered to the sump pressurization cavity 45 of at least one of the bearing assemblies, to prevent oil leakages and penetration of air towards the sump oil cavity. In some exemplary embodiments, the on-engine source of compressed air can comprise the low pressure compressor 12 or the high pressure compressor 14. More generally, an on-engine source of compressed air is any source of compressed air which is part of the gas engine motor and which is driven thereby, so that the delivery pressure of the on-engine source of compressed air is dependent upon the operating conditions of the gas turbine engine 10.

In some operating conditions, for example during engine low power and idle operations, the pressure of the air delivered to the sump pressurization cavity 45 through a duct 51 (FIG. 2) can be insufficient to prevent leakage of lubrication oil from the sump oil cavity 33 and penetration of hot air through the sealing members 47, 49 from the exterior of the sump pressurization cavity 45 towards the interior thereof and therefrom towards the sump oil cavity 33. If this happens, oil is "cooked" due to the high temperature of the air in the hot area of the gas turbine engine 10.

To prevent this situation for occurring, in some embodiments a sump pressurization system is provided, in combination with the on-engine source of compressed air.

Figure 3:
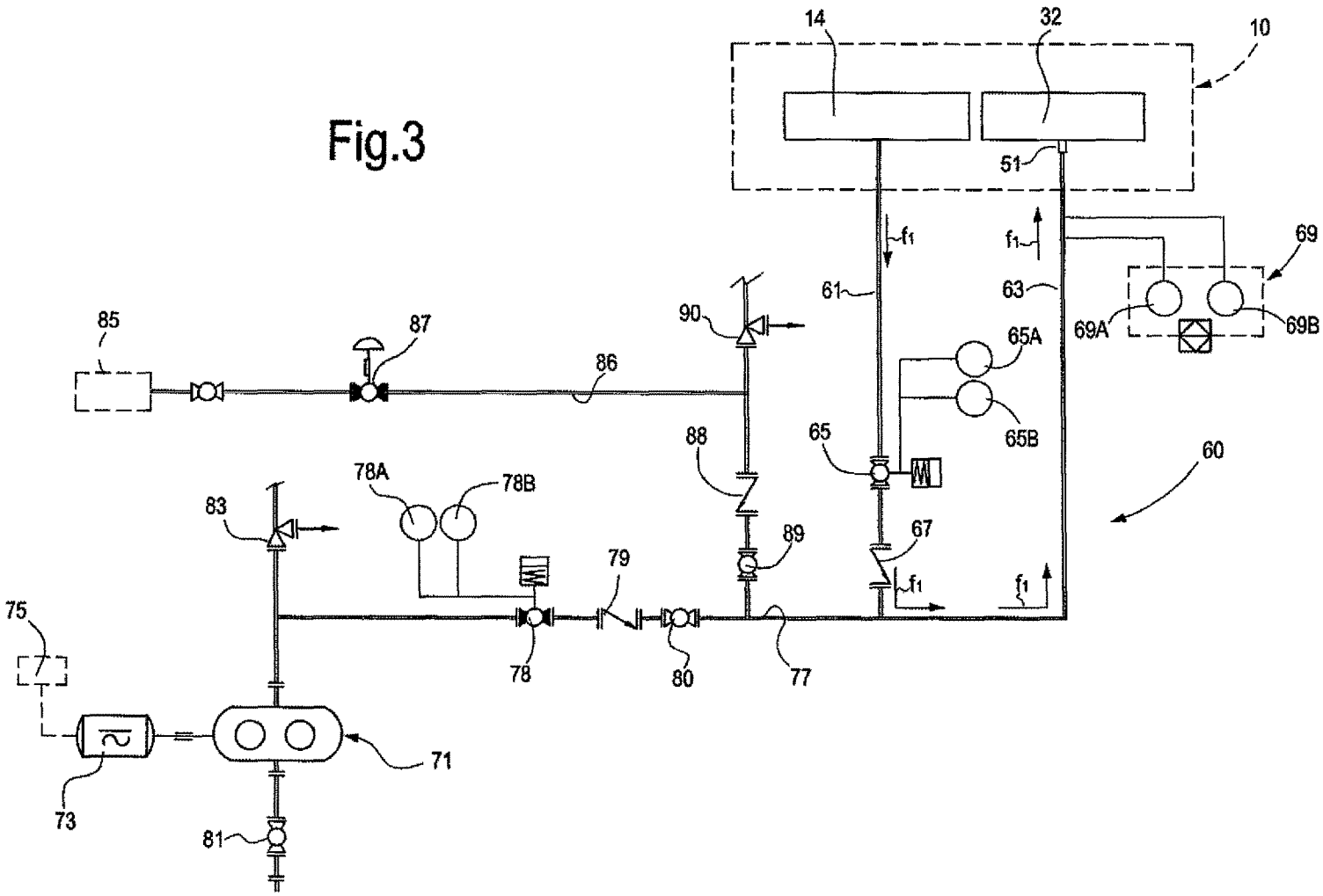
FIGS. 3, 4 and 5 illustrate a diagram of the pneumatic pressurization system for the bearing assembly of FIG. 2 in one embodiment and in different operating conditions.
Figure 4:
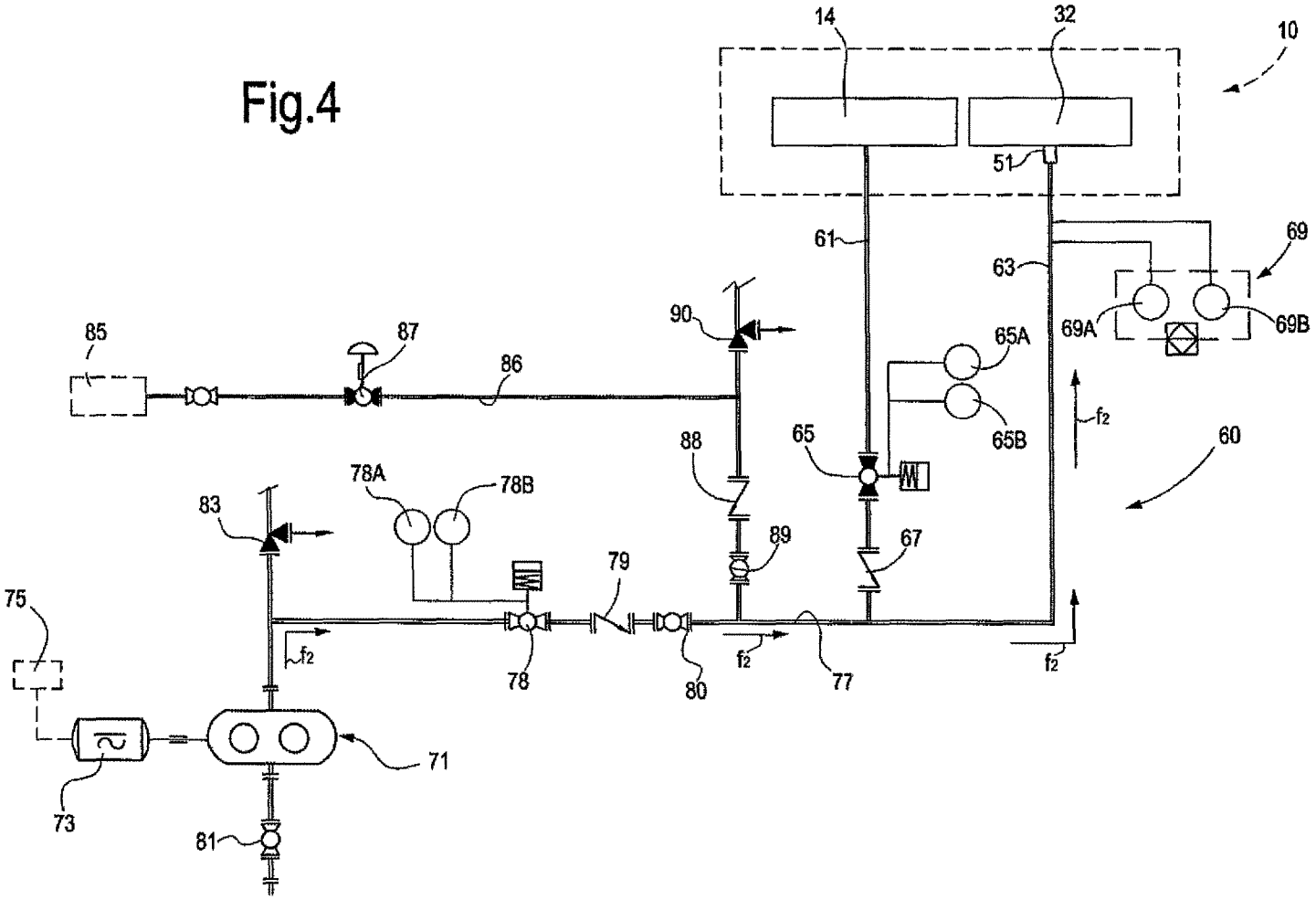
Figure 5:
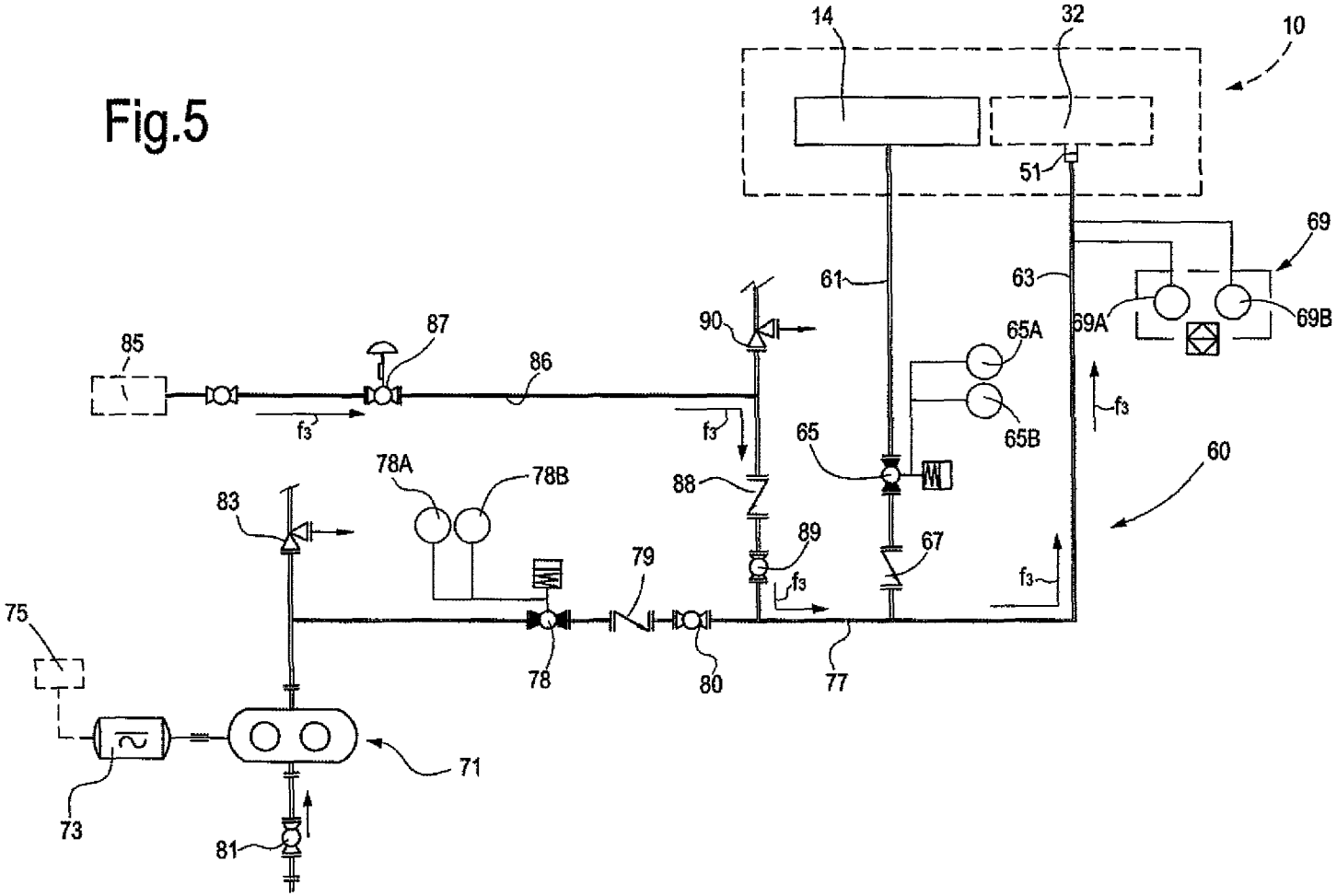

FIGS. 3, 4 and 5 schematically illustrate a diagram of an exemplary embodiment of a sump pressurization system in three different operating conditions. In FIGS. 3, 4 and 5 the gas turbine engine 10 along with the on-engine source of compressed air, labeled 14, and the bearing sumps, labeled 32.

According to some embodiments, the sump pressurization system, globally labeled 60, comprises a fluid connection 61, 63 between the on-engine source 14 of compressed air and the bearing sumps 32. The fluid connection 61, 63 extends outside the gas turbine engine 10 for the purposes which will become apparent from the following description.

Along the fluid connection 61 an engine side automatic isolation valve 65 is provided, in combination with a first check valve 67. Reference numbers 65A and 65B schematically designate a first position sensor and a second position sensor detecting the fully-opened and fully-closed position of the automatic isolation valve 65. In further embodiments, not shown, only one or the other of the valves 65, 67 can be provided. A position transducer instead of two position sensors can also be used.

A pressure detection system 69 detects the air pressure delivered to the sump pressurization cavity 45. In some embodiments the pressure detection system 69 can be comprised of a first pressure transducer 69A and a second pressure transducer 69B in parallel, forming a redundant configuration. In other embodiments more than two pressure transducers can be provided. In simpler embodiments, where less stringent safety conditions apply, a single pressure transducer can suffice.

In the exemplary embodiment of FIGS. 3, 4 and 5 the sump pressurization system 60 comprises a blower 71. In some embodiments the blower 71 can be a positive displacement blower. In other embodiments, a turbo-blower, for example a centrifugal compressor or a fan can be provided instead of a positive displacement blower. In the exemplary embodiment shown, the blower 71 is driven into rotation by an electric motor 73, for example an AC electric motor. The electric motor 73 can be controlled by a speed controller 75. The speed controller 75 can comprise a variable frequency driver, so that the speed of the blower 71 can be controlled.

The speed controller allows the delivery pressure of the blower 71 to be controlled. In other embodiments the blower can be operated at a fixed rotation speed and can be provided with a bleed valve or a similar arrangement, for adjusting the delivery pressure.

A pressurized air delivery duct 77 connects the blower 71 to the fluid connection 63. Along the pressurized delivery line 77 a blower side automatic isolation valve 78 can be provided. A check valve 79 can be arranged in series with the automatic isolation valve 78. In other embodiments, not shown, only one or the other of the valves 78, 79 can be provided. A manual valve 80 can further be arranged in series with valves 79 and 78. In some embodiments a first position sensor 78A and a second position sensor 78B can be associated with the automatic isolation valve 78, to detect a fully-closed position and a fully-opened position of the valve 78, respectively. The two position sensors can be replaced by a position transducer.

According to some embodiments, a further manual valve 81 can be provided upstream of the blower 71 and a pressure safety valve 83 can be provided downstream of the blower 71.

A further compressed air supply, globally shown at 85, can be connected through a line 86 to fluid connection 63 between the pressure source 14 and the bearing sumps 32. The compressed air supply 85 can be for example a compressed air service line of a plant where the gas turbine engine 10 is installed.

In some embodiments, an automatic isolation/pressure control valve 87 is arranged between the compressed air supply 85 and the fluid connection 61, 63. A check valve 88 and/or a manual valve 89 can further be arranged in series with the automatic isolation valve 87. A position sensor 87 can be provided to detect the fully-closed position of the automatic isolation/pressure control valve 87. In some embodiments a position transducer sensor can be associated with the automatic isolation/pressure control valve 78, to detect the actual position. Finally, a pressure safety valve 90 can be connected to the line 86. In some embodiments one of the valves 88 and 87 can be omitted.

The operation of the sump pressurization system 60 described so far will now be explained in greater detail, reference being made to FIGS. 3, 4 and 5.

In FIG. 3 the gas turbine engine 10 is operating for example at full power, and the on-engine source of compressed air, for example the high pressure compressor 14, provides sufficient pressure to the sump pressurization cavity 45 of the bearing sumps 32. This is represented by arrows f1, showing air circulating from the on-engine pressure source 14 towards the bearing sumps 32 along the fluid connection 61, 63. The engine side automatic isolation valve 65 is opened, while the blower side automatic isolation valve 78 and the automatic isolation/pressure control valve 87 are closed. The blower 71 is non-operating or the valve 83 is opened.

If the pressure of the air delivered through the fluid connection 61, 63 by the on-engine pressure source 14 of the gas turbine engine 10 become insufficient to properly pressurize the sump pressurization cavity 45 of the bearing sumps, either one or the other of the compressed air auxiliary sources 71, 85 will become operative. Drop in the air pressure delivered to the sump pressurization cavity 45 is detected by the pressure transducer system 69.

If the pressure transducer system 69 detects a drop of the air pressure below a threshold, the following operations are performed. The engine side automatic isolation valve 65 is closed and the blower side automatic isolation valve 78 is opened. The blower 71 is started and the automatic isolation/pressure control valve 87 remains closed. Pressurized air will thus be delivered by the blower 71 to the bearing sumps 32 through fluid connection 63 as show by arrows f2 in FIG. 4. The speed of the blower 71 can be controlled through the blower speed control system 75 until the proper pressure value is detected by the pressure transducer system 69. The controller 75 maintains the blower rotation speed at the proper value to provide the correct pressure in the sump pressurization cavities.

Closing the valve 65 prevents pressurized air from the blower 71 to enter the gas turbine engine 10. In this operating condition, shown in FIG. 4, the sump pressurization cavities 45 are maintained under sufficient pressure condition on the one side to prevent oil leakage from the sump oil cavity 33 towards the sump pressurization cavity 45 and on the other side to prevent penetration of high-temperature air into the sump pressurization cavity 45 and therefrom into the sump oil cavity 33 with consequent damages to the lubrication oil due to the high temperature of the air surrounding the sump pressurization cavity 45 especially in the hot area of the gas turbine engine 10.

The pressure transducer system 69 continuously detects the pressure of the air delivered towards the sump pressurization cavity 45. If such pressure drops beyond a threshold value, which is required to achieve the effect of preventing oil leakage and hot air penetration, for example due to malfunctioning of the blower 71, the sump pressurization system 60 is switched to the mode of operation shown in FIG. 5. The blower side automatic isolation valve 78 is closed, the engine side automatic isolation valve 65 remains closed and the automatic isolation/pressure control valve 87 is 5 opened. Compressed air from the compressed air supply 85 is thus delivered (see arrow f3 in FIG. 5) along the line 86 towards the fluid connection 63 and to the bearing sumps 32.

In this embodiment therefore the compressed air supply 85 provides a safety auxiliary source to be used in case of failure of the blower 71.

Figure 6:
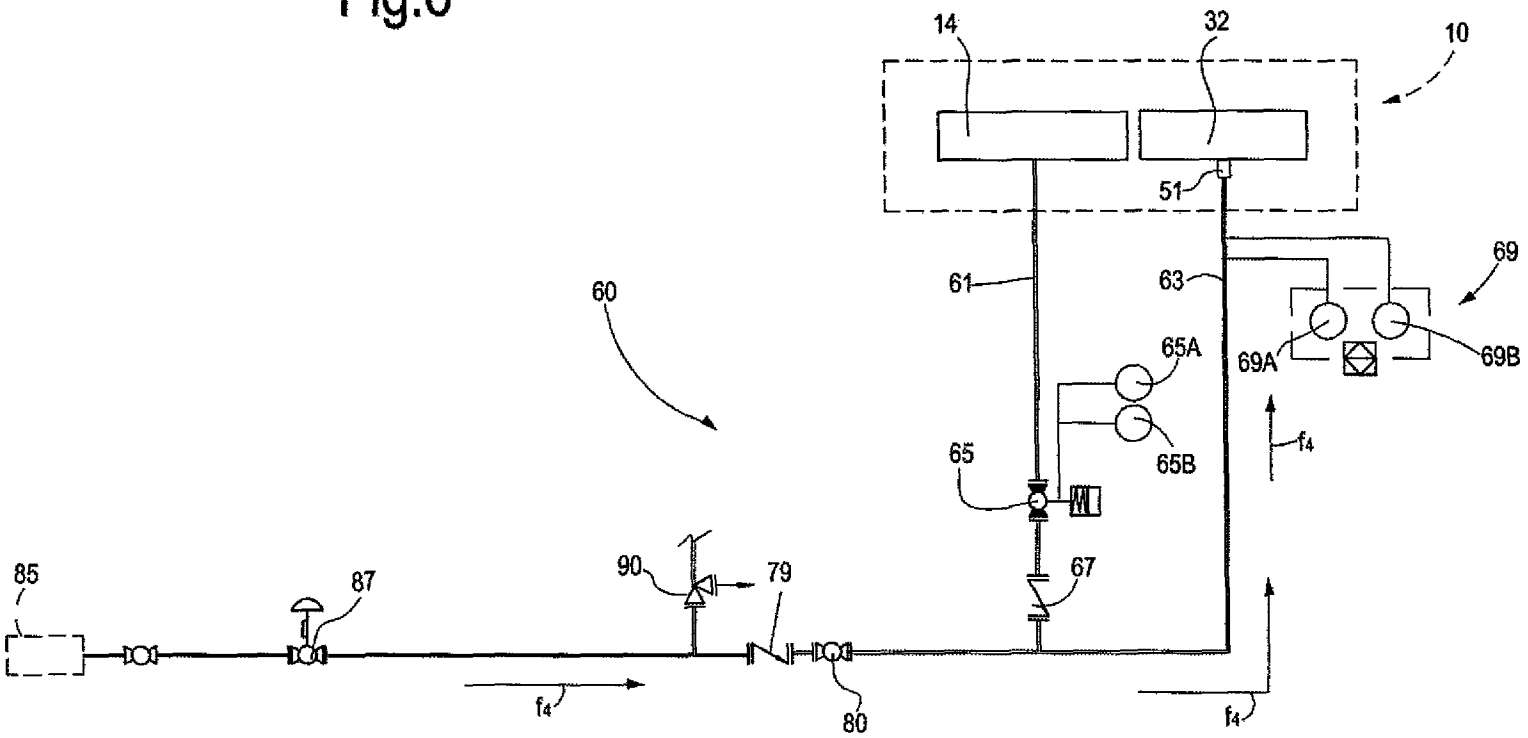
FIG. 6 illustrates a diagram of a pneumatic pressurization system in a further embodiment.

According to a further embodiment, schematically shown in FIG. 6, the compressed air supply 85 can be the only compressed air supply or source of the sump pressurization system 60, arranged outside the gas turbine engine 10. The same reference numbers are used in FIG. 6 to designate the same or corresponding components, parts or elements as in the embodiment of FIGS. 3, 4 and 5.

When the pressure transducer system 69 detects a drop in the pressure of the air delivered to the bearing sumps, the engine automatic isolation valve 65 is closed and the automatic isolation valve 87 is opened to allow compressed air from the compressed air supply 85 to flow (arrow f4) towards the bearing sumps through line 63.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A method for operating a gas turbine engine to facilitate reducing leakage of lubrication oil, the gas turbine engine comprising: at least one bearing assembly arranged in a sump oil cavity, and a sump pressurization cavity at least partly encasing the sump oil cavity and in fluid communication therewith; the method comprising the steps of: supplying sump pressurization air to the sump pressurization cavity from an air source on-board of said gas turbine engine, to maintain in said sump pressurization cavity an operating pressure higher than a pressure in said sump oil cavity; when air pressure from the air source on-board of the gas turbine engine is insufficient to maintain said operating pressure in the sump pressurization cavity, supplying supplemental sump pressurization air to said sump pressurization cavity from at least one auxiliary pressurized-air source external to and independent of the gas turbine engine.

2. The method of claim 1, wherein the step of supplying supplemental sump pressurization air comprises operating an air blower.

3. The method of claim 2, wherein the step of supplying supplemental sump pressurization air comprises operating the air blower at a variable rotation speed to maintain the operating pressure in the sump pressurization cavity.

4. The method of claim 1, wherein the sump pressurization cavity comprises first sealing members for sealing first shaft passageways between the sump oil cavity and the sump pressurization cavity, and second sealing members for sealing second shaft passageways between the sump pressurization cavity and a surrounding environment; and wherein the operating pressure in the sump pressurization cavity is maintained at a level sufficient to prevent air from penetrating through the second sealing members inside the sump pressurization cavity.

5. The method of claim 1, further comprising the steps of detecting a pressure which is indicative of a pressure inside the sump pressurization cavity; if the detected pressure is below a minimum sump pressure threshold, fluidly connecting the sump pressurization cavity with a supplemental pressurized-air delivery line and delivery supplemental sump pressurization air through said supplemental air delivery line to the sump pressurization cavity.

6. The method of claim 1, wherein: the sump pressurization cavity is in fluid communication with a pressurized air duct, said pressurized air duct being in fluid communication selectively with an on-engine source of pressurized air on the gas turbine engine and with an off-engine supplemental air delivery line;

wherein a first valve arrangement is provided between the gas turbine engine and the pressurized air duct and a second valve arrangement is provided between the supplemental air delivery line and said at least one auxiliary pressurized-air source; and wherein said method comprises the step of closing the first valve arrangement and opening the second valve arrangement when the air pressure from the on-engine source of pressurized air is insufficient to maintain said operating pressure in the sump pressurization cavity.

7. A sump pressurization system for a gas turbine engine, comprising: a sump oil cavity housing a bearing assembly; a sump pressurization cavity at least partly encasing said sump oil cavity and in flow communication therewith; a supplemental pressurized-air delivery line for flow connection between the sump pressurization cavity and at least one auxiliary pressurized-air source external to and independent of the gas turbine engine; a pressurized-air line for flow connection between the sump pressurization cavity and the gas turbine engine; and a valve arrangement for connecting the sump pressurization cavity selectively with the pressurized-air line, or with the supplemental pressurized-air delivery line.

8. The sump pressurization system of claim 7, wherein the supplemental pressurized-air delivery line is configured for flow connection with said at least one auxiliary pressurized-air source and a further auxiliary pressurized-air source.

9. The sump pressurization system of claim 7, wherein said at least one auxiliary pressurized-air source comprises a blower.

10. The sump pressurization system of claim 8, wherein said further auxiliary pressurized-air source comprises a blower.

11. The sump pressurization system of claim 9, wherein said blower is driven by a variable-speed driver.

12. The sump pressurization system of claim 7, further comprising a scavenge pump in fluid communication with the sump oil cavity.

13. A gas turbine engine comprising:

at least one bearing assembly; and a sump pressurization system configured to supply lubrication oil to the bearing assembly, the sump pressurization system being in accordance with claim 7, said bearing assembly being arranged in the sump oil cavity.

14. A gas turbine engine comprising: at least one bearing assembly; a sump pressurization system comprised of: a sump oil cavity encasing said bearing assembly, and a sump pressurization cavity, wherein the sump oil cavity is at least partly encased within the sump pressurization cavity and in flow communication therewith; a pressurized-air connection line fluidly connecting said sump pressurization cavity and an air source of said gas turbine engine; a supplemental pressurized-air connection line fluidly connecting the sump pressurization cavity with at least one auxiliary pressurized-air source external to and independent of the gas turbine engine; and a valve arrangement for fluidly connecting the sump pressurization cavity selectively with the pressurized-air connection line and with the supplemental pressurized-air connection line.

15. The gas turbine engine of claim 14, wherein the air source of the gas turbine engine comprises said at least one air compressor of the gas turbine engine.

16. The gas turbine engine of claim 15, wherein said valve arrangement is arranged and controlled to connect the sump pressurization cavity with the supplemental pressurized-air source when the pressurized air delivered by the gas turbine is insufficient to maintain an operating pressure value in the sump pressurization cavity.

17. The gas turbine engine of claim 14, further comprising a second auxiliary pressurized-air source.

18. The gas turbine engine of claim 17, wherein said valve arrangement comprises:

first valve members to establish a fluid connection between the sump pressurization cavity and the pressurized-air connection line;

second valve members to establish a fluid connection between the sump pressurization cavity and said at least one auxiliary pressurized-air source; and third valve members to establish a fluid connection between the sump pressurization cavity and said second auxiliary pressurized-air source.

19. The gas turbine engine of claim 14, wherein said at least one auxiliary pressurized-air source comprises a blower.

20. The gas turbine engine of claim 14, wherein said valve arrangement is arranged and controlled to alternatively establish a fluid connection between the sump pressurization cavity and the pressurized-air connection line and close the supplemental pressurized-air connection line; or close the pressurized-air connection line and establish a fluid connection between the sump pressurization cavity and the supplemental pressurized-air connection line.

* * * * *